US005457935A

United States Patent [19]

Kope

[11] Patent Number: 5,457,935

[45] Date of Patent: Oct. 17, 1995

[54] PARALLEL LINKAGE LOADING RAM

[76] Inventor: David P. Kope, 1474 N. Reed Ave., Reedley, Calif. 93654

[21] Appl. No.: 273,783

[22] Filed: Jul. 12, 1994

[51] Int. Cl.[6] ..... B65B 35/20; B65B 65/02

[52] U.S. Cl. ..... 53/258; 53/252

[58] Field of Search ..... 53/252, 251, 235, 53/258, 255, 260, 566, 473, 467

[56] References Cited

U.S. PATENT DOCUMENTS

| | | | |
|---|---|---|---|
| 2,853,177 | 9/1958 | Engleson et al. | 53/252 X |
| 3,004,374 | 10/1961 | Pembroke | 53/252 X |
| 3,333,674 | 6/1967 | Homan . | |
| 3,603,059 | 9/1971 | Carnes et al. | 53/258 |
| 3,821,874 | 3/1974 | Jones | 53/252 X |
| 3,981,121 | 9/1976 | Turunen et al. | 53/258 X |
| 4,164,278 | 7/1979 | Gurioli | 198/487 |
| 4,250,688 | 7/1981 | Lingenfelder | 53/438 |
| 4,457,124 | 11/1984 | Hartmann | 53/512 |
| 4,534,153 | 12/1985 | Nowicki | 53/448 |
| 4,703,608 | 7/1987 | Kovacs | 53/410 |
| 4,709,535 | 12/1987 | Mahaffy et al. | 53/252 X |
| 4,750,317 | 3/1988 | Vrana | 53/541 |
| 4,815,257 | 1/1989 | Hayes, Jr. | 53/473 |
| 4,982,556 | 8/1991 | Tisma | 53/252 X |

*Primary Examiner*—James F. Coan
*Attorney, Agent, or Firm*—Mark D. Miller

[57] ABSTRACT

A parallel linkage loading apparatus designed to be made part of a larger case packing machine which has a special retraction operation to improve efficiency. The push plate (ram) of the apparatus is lifted up and around in a predetermined path as it is retracted, instead of pulling horizontally straight back. This retraction motion allows for the simultaneous positioning of subsequent sets of the product material (under the lifting push plate), avoiding the delay associated with waiting for this positioning after full retraction. Immediately upon completion of the retraction operation, the push plate may extend forward again, without delay, to push the waiting product materials into the next waiting case.

2 Claims, 5 Drawing Sheets

PARALLEL LINKAGE LOADING RAM

BACKGROUND OF THE INVENTION

1. Field of the Invention

The present invention relates to automated packaging machinery, and in particular, to a new and improved apparatus for pushing and loading product materials into packages which apparatus is made part of a larger case loading machine.

2. Description of the Prior Art

In the packaging industry numerous different machines have been developed which erect, fill, seal and close different kinds of containers ("cases") for goods. Many machines include component parts which accomplish each or all of these tasks. The present invention is a component of such a machine which inserts or pushes materials into an open case prior to sealing and closure.

There are numerous automated machines in the prior art designed to push or insert materials into cases. Virtually all of these machines include a pusher or ram mechanism which moves horizontally back and forth between a retracted and extended position. When retracted, a conveyor brings the material to be inserted in front of the ram. Meanwhile, the case into which the material is to be inserted is aligned on the opposite side of the material from the ram. The ram is then extended, pushing the material into the case. The ram is then retracted straight back. Once retracted, the conveyor brings the next set of materials and the next case into position and the process is repeated.

There is a significant delay associated with waiting for the ram to be completely retracted before the next set of materials can be moved into position. Elimination of this delay would increase productivity by increasing the number of cases that could be filled during a given time interval. The present invention solves this problem by providing a new retraction operation whereby the ram is lifted up and around in a defined path, instead of straight back. This motion allows for the simultaneous conveyance and positioning of the material to be inserted, so that there is little or no delay in extending the ram forward again to push the material into the waiting case.

SUMMARY OF THE INVENTION

The present invention overcomes the above-described delay associated with waiting for a product to be positioned in front of the loading ram by providing a parallel linkage loading apparatus having a special retraction operation whereby the push plate (ram) of the apparatus is lifted up and around in a predetermined path as it is retracted, instead of pulling horizontally straight back. This retraction motion is accomplished by means of a series of linkages and pivots which cause the retracting push plate to pull up and over the area where the product is placed. Simultaneously with the lifted pusher retraction, the next set of the product material is positioned in place so that immediately upon completion of the retraction operation, the push plate may extend forward again, without delay, to push the product into the next waiting case.

It is therefore a primary object of the present invention to provide a product loading apparatus to be made part of a larger case loading machine which allows for more efficient and continuous rapid insertion of product materials into cases without the delay associated with positioning subsequent sets of product materials.

It is a further object of the present invention to provide a highly efficient mechanism for positioning and inserting product materials into cases which avoids the delay associated with waiting for horizontal retraction of the push plate before moving product materials into position by providing a lifted retraction operation that allows for simultaneous positioning of subsequent product materials.

It is a further object of the present invention to provide a parallel linkage loading device which has a unique retraction operation whereby the push plate (ram) of the apparatus is lifted up and around in a defined path as it is retracted, instead of pulling horizontally straight back.

It is a further object of the present invention to provide a loading device having a unique upwardly lifted retraction operation that allows subsequent sets of product materials to be positioned for insertion simultaneously with the retraction operation.

DETAILED DESCRIPTION OF THE DRAWINGS

Figure 1:
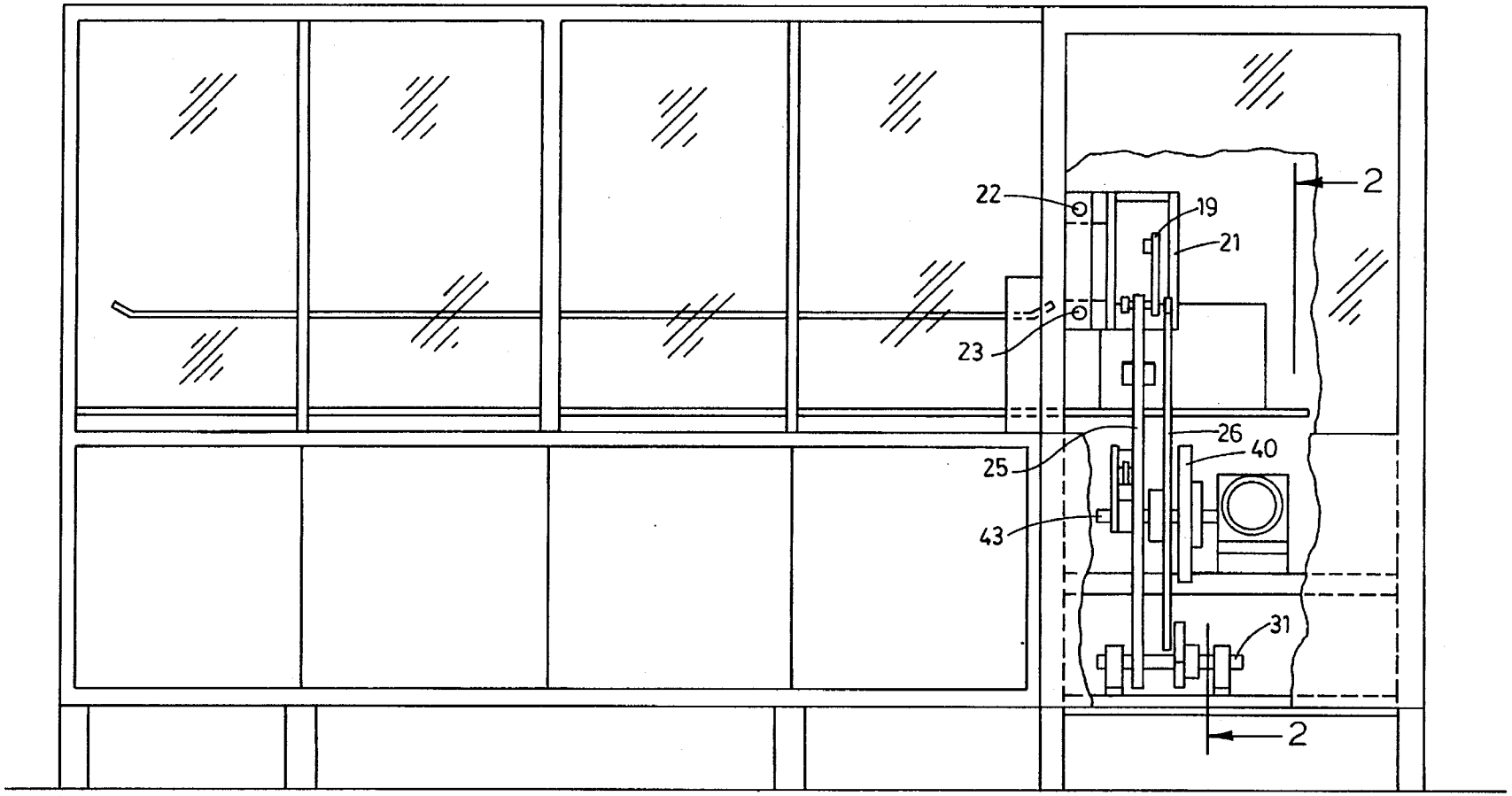
FIG. 1 is a partially cut away end view of the present invention, showing its relationship to a larger case loading machine.
Figure 2:
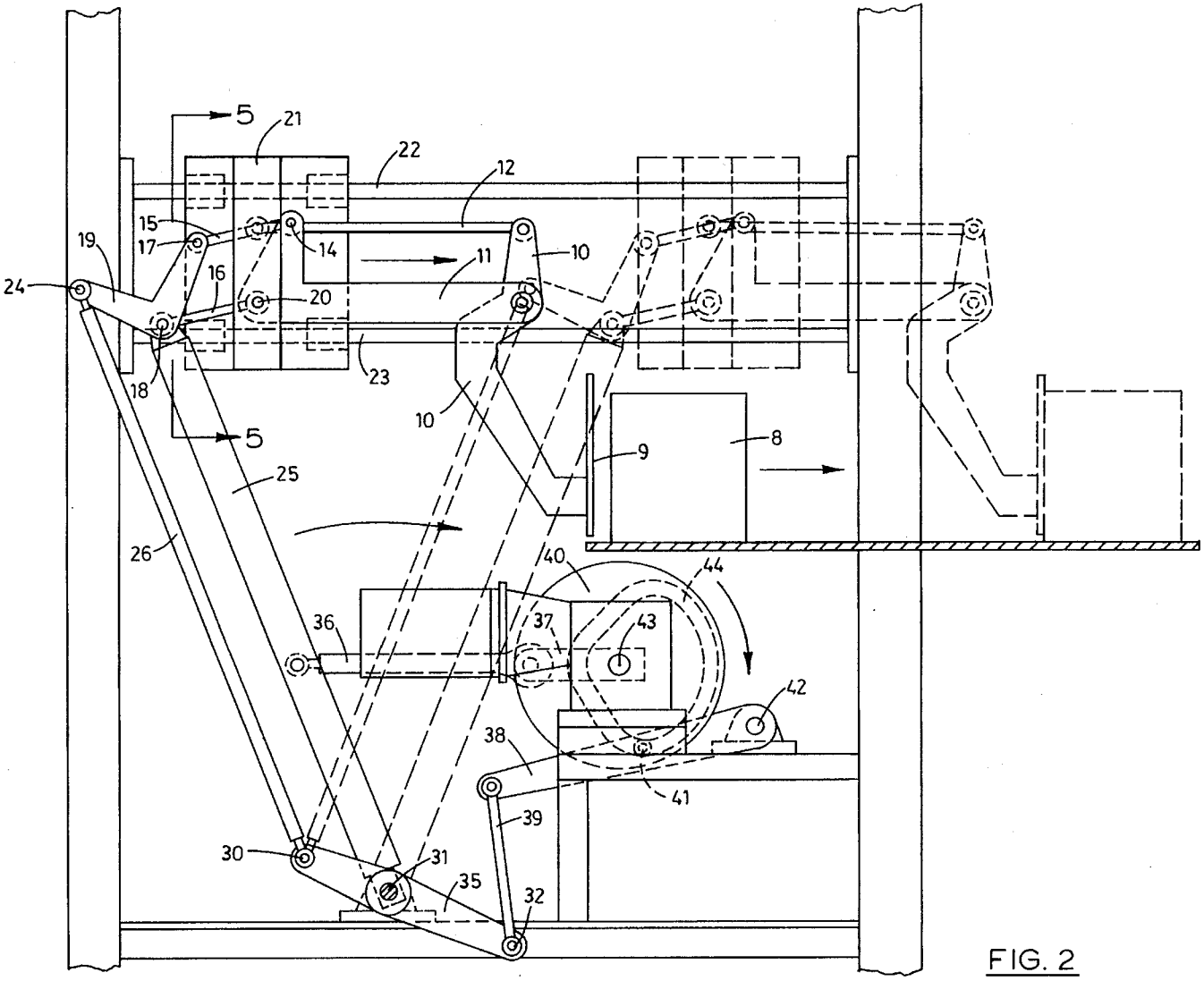
FIG. 2 is a partially cut away side view of the invention along lines 2—2 of FIG. 1 showing it in the fully retracted position. The phantom lines show the (next—FIG. 3) extended position.
Figure 5:
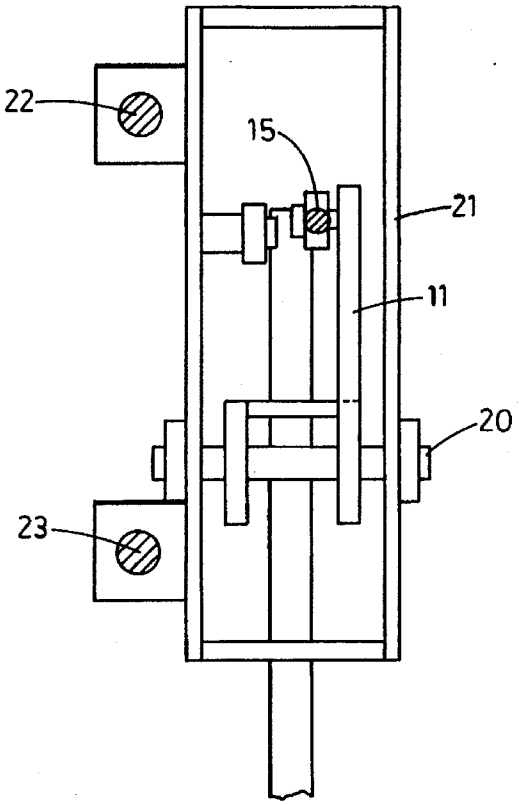
FIG. 5 is an end view of the top of present invention along line 5—5 of FIG. 2, showing the upper horizontal carriage.

Referring to the drawings wherein like reference characters designate like or corresponding parts throughout the several views, and referring particularly to FIG. 2, it is seen that the invention includes a flat vertical push plate (or ram) 9 attached to a support member 10 which member is pivotally mounted to one end of an upper 12 and lower 11 thrust bar. The bottom of the opposite end of lower thrust bar 11 is pivotally attached at 20 to box 21 (see FIG. 5) and to connector bar 16. Box (carriage) 21 is, in turn, slidably attached to a pair of horizontal parallel support and guide members 22 and 23. Guide members 22 and 23 define the path that carriage 21 rides on.

The top 14 of the opposite end of lower thrust bar 11 is pivotally attached to connector bar 15. Connector bars 15 and 16 are pivotally attached, respectively, to the top right corner and bottom of V-shaped lever 19. The V-bottom of lever 19 is also pivotally attached to the top end of power member 25. The top left corner 24 of V-lever 19 is pivotally attached to the top end of motion transfer member 26. The opposite end of power member 25 is pivotally attached to lever 35 at middle pivot 31; and the opposite end of transfer member 26 is pivotally attached to lever 35 at end pivot 30.

Intermediate the ends of power member 25 is attachment bar 36 which is, in turn, pivotally attached to crank 37 which is rotationally fixed to cam 40 by means of shaft 43. As shaft 43 spins, it rotates crank 37 and cam 40 around in a circle, causing attachment bar 36 to move back and forth thereby moving power member 25 back and forth around pivot 31.

Lever 35 has an opposite end pivot 32 which is pivotally attached to transfer member 39. Member 39 is, in turn, pivotally attached to one end of cam follower arm 38 which follows semi-oval shaped cam track 44 by means of follower 41. The opposite end of cam follower arm 38 is pivotally mounted at base 42.

In operation, the present invention starts at the retracted rest position shown in FIG. 2. Shaft 43 imparts, directly or indirectly, all motion to the apparatus. As shaft 43 rotates clockwise, it rotates crank 37 around causing bar 36 to pull power member 25 from the left to the right around pivot 31. Because power member 25 is attached to V-shaped lever 19, it pulls said V-lever (and transfer member 26) from the left to the right until it reaches the position shown in FIG. 3. At the same time, thrust bar 11 is moved horizontally from the left to the right, pushing support member 10 and push plate 9 horizontally to the right, thereby moving the product material 8 out. This fully extended position is shown in FIG. 3.

Figure 3:
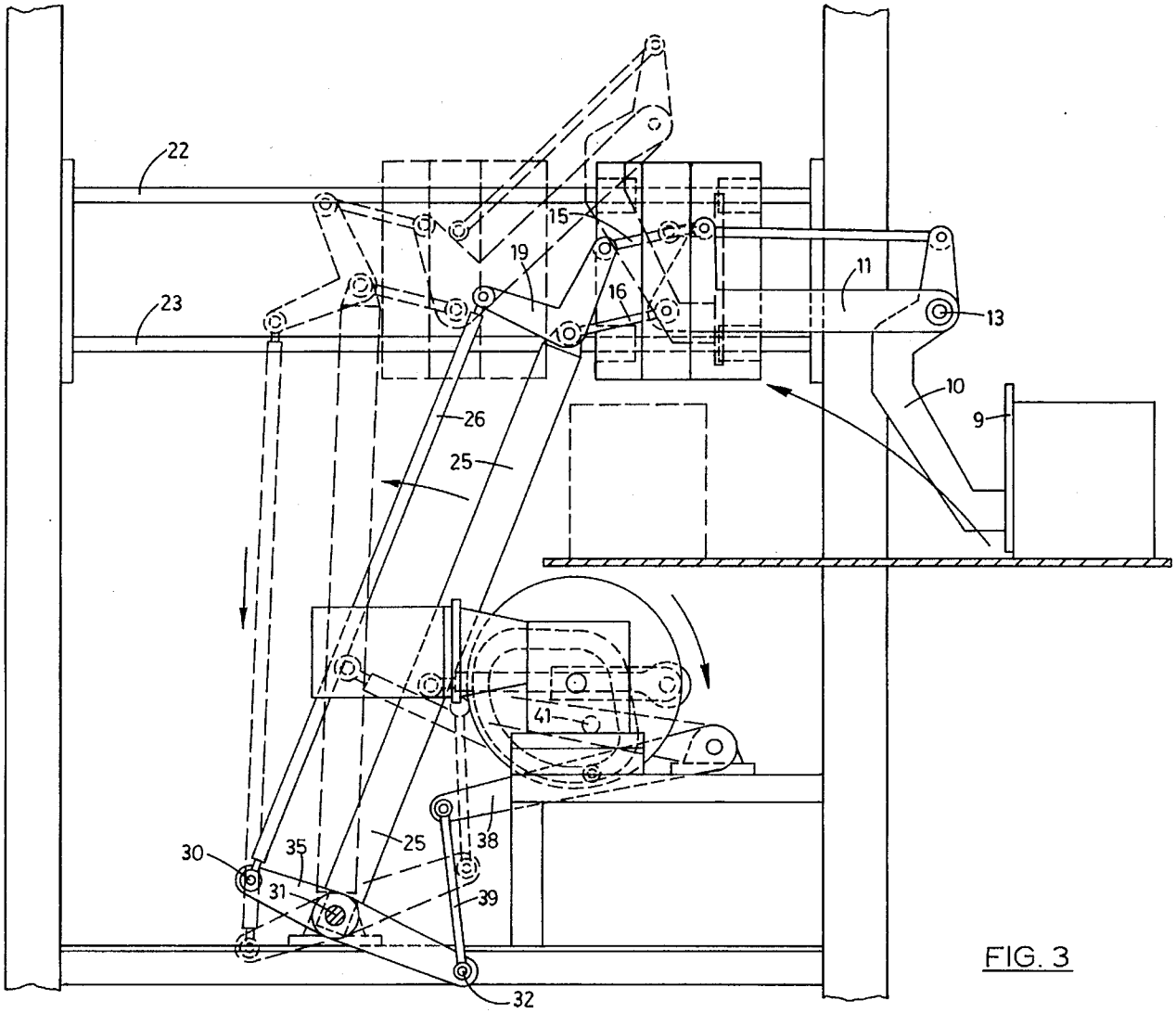
FIG. 3 is a partially cut away side view of the invention showing it in the fully extended position. The phantom lines show the (next—FIG. 4) partially retracted position.
Figure 4:
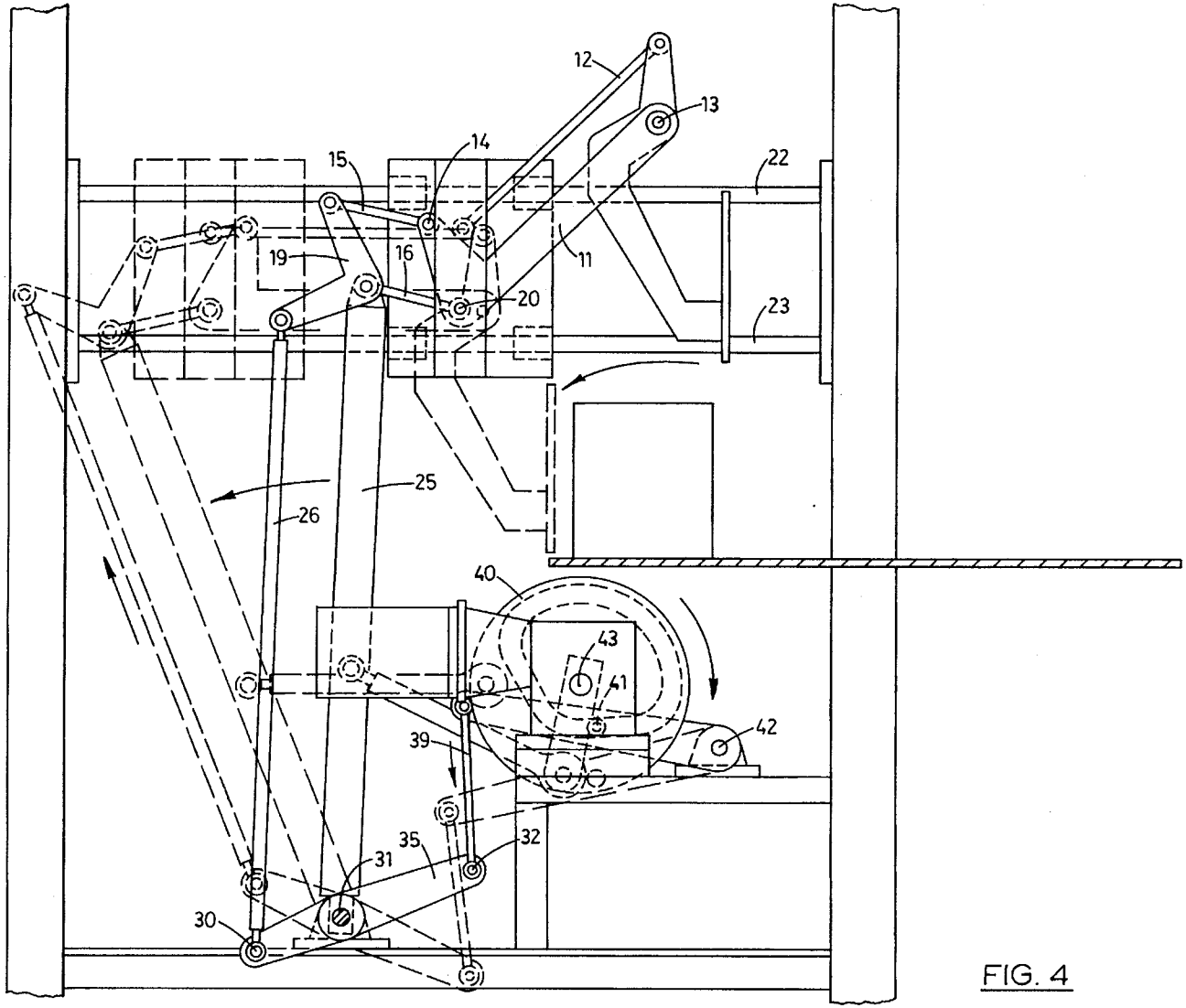
FIG. 4 is a partially cut away side view of the invention showing the upwardly lifted partially extended position. The phantom lines show the invention fully retracted (see FIG. 2).

Referring then to FIGS. 3 and 4, as shaft 43 continues in a clockwise turn, cam track 44 causes follower 41 to move from its lower position (see FIG. 3) to an upper position (see FIG. 4). This movement causes transfer member 39 to move up, shifting lever 35 from the position shown in FIGS. 2 and 3 to the position shown in FIG. 4. This pulls transfer member 26 down, rotating V-lever 19 counter clockwise around its base pivot 18.

At the same time as cam 40 causes the above-described shift, attachment bar 36 pushes power member 25 back from the right to the left. However, in this retraction, because V-lever 19 is being rotated, thrust bar 11 is not pulled back horizontally, but is instead rotated upward around pivot 20 through the interaction of arms 12, 15, and 16 and pivots 13, 14, 17, 18 and 20.

In an alternative embodiment, not shown, transfer member 26, V-lever 19 and bar 16 may be replaced by chain and sprocket means. A first sprocket is attached to lever 35 at pivot 31, a second rotatable (double) sprocket is attached at pivot 18, and a third fixed sprocket is attached to thrust member 11 at pivot 20. A first chain connects the two sprockets at pivots 31 and 18; and a second chain connects the two sprockets at pivots 18 and 20. In this embodiment, when lever 35 is pulled upward, it rotates the first sprocket at pivot 31. This rotation is transferred through the first chain to pivot 18, causing the second sprocket at that location to also rotate. In turn, the second sprocket causes the second chain to rotate the third fixed sprocket at pivot 20, moving thrust member 11 up.

The combined retraction and shifting action causes support member 10 and push plate 9 to be lifted up and over the area where a new unit of product material 8 is simultaneously placed. There is no delay in this cycle to wait for the positioning of the next piece of product material. Instead, shaft 43 completes one full turn through this process, leaving the apparatus of the present invention immediately ready to push the next unit of product material into place.

DESCRIPTION OF THE PREFERRED EMBODIMENTS

In the preferred embodiment, the apparatus of the present invention is made a part of a larger case loading machine. Most of the fixed components of the apparatus should be made of metal, although for some parts, a strong and durable plastic material may be substituted. A conveyor for the product materials to be inserted should be included in the overall machine in order to continuously deliver product for insertion into the cases. Likewise, a similar conveyor for the cases themselves should be provided.

In an alternative embodiment, the motion transfer members (26, V-lever 19 and bar 16) may be replaced by chain and sprocket means mounted at the same pivots (31, 18 and 20).

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A loading ram apparatus comprising:

a. a flat vertically positioned push plate attached to a support member;

b. an intermediate thrust member pivotally attached to said support member at one end and a guide means and slidable carriage at the opposite end;

c. a V-shaped pivoting member pivotally attached by rod means at its top right and bottom ends to the opposite end of said thrust member;

d. a power arm pivotally attached at one end to the bottom of said V-shaped member;

e. a motion transfer means pivotally attached at one end to the top left end of said V-shaped member;

f. a lever means, the middle of which is pivotally attached to the opposite end of said power arm, and one end of which is pivotally attached to the opposite end of said transfer means;

g. a rotatable shaft, crank & cam means pivotally attached by rod means to said power member and to the opposite end of said lever means; whereby, as said shaft, crank & cam rotates through one full cycle, said power member first moves said V-shaped member, said thrust member and said push plate horizontally in one direction according to said guide means; as said shaft, crank & cam continues to rotate, said lever is pivoted so that said transfer means is pulled down rotating said V-shaped member and said thrust member up, thereby lifting said support member and push plate up while at the same time said power member pulls said V-shaped member, slidable carriage means, support member and push plate back in the opposite direction creating a lifting retraction motion; as said shaft, crank & cam completes one rotation, all of said members are positioned to repeat these motions.

2. A case loading apparatus comprising:

a. a push plate and mounting means pivotally attached to a rotatable thrust member and slidable carriage mechanism;

b. a means for imparting forward and backward motion to said carriage mechanism;

c. a motion transfer means pivotally mounted to said thrust member at one end and to a movable lever at the opposite end;

d. a rotatable cam having an oval-shaped track thereon and a cam track follower therein, said follower attached by pivoting rod means to the opposite end of said movable lever; whereby as said cam rotates through one entire cycle, said push plate is extended forward in a horizontal motion and thereafter retracted backward in an upwardly lifting motion, said lifting motion imparted as a result of the oval-shaped cam track causing an interaction of the lever and motion transfer means to rotate said thrust mechanism upward while it is also being pulled backward along the slidable carriage.

* * * * *